US010753317B2

(12) United States Patent
Nakagawa

(10) Patent No.: US 10,753,317 B2
(45) Date of Patent: Aug. 25, 2020

(54) EGR CONTROL DEVICE

(71) Applicant: TOYOTA JIDOSHA KABUSHIKI KAISHA, Toyota-shi, Aichi-ken (JP)

(72) Inventor: Masayoshi Nakagawa, Mishima (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 32 days.

(21) Appl. No.: 16/181,731

(22) Filed: Nov. 6, 2018

(65) Prior Publication Data

US 2019/0145357 A1 May 16, 2019

(30) Foreign Application Priority Data

Nov. 15, 2017 (JP) ..... 2017-220038

(51) Int. Cl.
*F02M 26/05* (2016.01)
*F02M 26/39* (2016.01)
*F02M 26/00* (2016.01)

(52) U.S. Cl.
CPC ..... *F02M 26/05* (2016.02); *F02M 26/39* (2016.02); *F02M 2026/005* (2016.02)

(58) Field of Classification Search
CPC ..... F02M 26/05; F02M 26/39; F02M 26/16; F02M 26/21
USPC ..... 60/605.2; 123/568.2; 701/108
See application file for complete search history.

(56) References Cited

U.S. PATENT DOCUMENTS 5,327,725 A * 7/1994 Mitsubori ..... F02M 26/05 60/605.2
5,937,834 A * 8/1999 Oto ..... F02M 26/05 60/605.2
6,973,786 B1 * 12/2005 Liu ..... F02M 26/07 123/568.2
7,591,256 B2 * 9/2009 Elsasser ..... F02M 26/40 123/568.2
7,726,287 B2 * 6/2010 Sekfane ..... F02D 41/0055 123/568.2

(Continued)

FOREIGN PATENT DOCUMENTS

FR 2892770 A1 * 5/2007 ..... F02M 26/39
JP 07293354 A * 11/1995 ..... F02M 26/39

(Continued)

*Primary Examiner* — Thai Ba Trieu
(74) *Attorney, Agent, or Firm* — Finnegan, Henderson, Farabow, Garrett & Dunner, LLP

(57) ABSTRACT

An internal combustion engine includes a supercharger having a compressor and a turbine and an EGR apparatus having an exhaust recirculating pipe, an upstream EGR valve and a downstream EGR valve. An electronic control unit fully opens the upstream EGR valve and controls an EGR amount by the downstream EGR valve when a peak value of an exhaust pressure increases excessively. The resulting increase in exhaust volume causes the peak value of the exhaust pressure to fall, and damage to parts of an exhaust system can be avoided. The electronic control unit fully opens the downstream EGR valve and controls the EGR amount by the upstream EGR valve when the peak value of the exhaust pressure decreases excessively. The resulting decrease in the exhaust volume causes the peak value of the exhaust pressure to rise, enabling supercharging.

5 Claims, 5 Drawing Sheets

(56) References Cited

U.S. PATENT DOCUMENTS

| | | | | |
|---|---|---|---|---|
| 7,963,101 | B2 * | 6/2011 | Suzuki | F02D 41/0275 60/285 |
| 8,955,499 | B2 * | 2/2015 | Takamiya | F02D 41/042 123/568.12 |
| 2006/0137665 | A1 * | 6/2006 | Khair | F02M 26/05 123/568.2 |
| 2010/0146968 | A1 * | 6/2010 | Simpson | F02M 26/05 60/605.2 |
| 2011/0289914 | A1 * | 12/2011 | Afjeh | F02M 26/05 60/602 |
| 2013/0312715 | A1 * | 11/2013 | Takamiya | F02D 41/042 123/568.12 |
| 2016/0363043 | A1 * | 12/2016 | Hirayama | F02D 41/0007 |
| 2017/0030259 | A1 * | 2/2017 | Tabata | F02D 41/0007 |
| 2017/0067394 | A1 * | 3/2017 | Tsuda | F02M 26/05 |
| 2020/0072144 | A1 * | 3/2020 | McHenry | F02M 26/05 |

FOREIGN PATENT DOCUMENTS

| | | | | |
|---|---|---|---|---|
| JP | H08-246889 | | 9/1996 | |
| JP | 11062722 | A * | 3/1999 | F02M 26/50 |
| JP | 2001099012 | A * | 4/2001 | F02M 26/39 |
| JP | 2004-068631 | | 3/2004 | |
| JP | 2009-091917 | | 4/2009 | |
| JP | 2010-031648 | | 2/2010 | |

* cited by examiner

EGR CONTROL DEVICE

TECHNICAL FIELD

The present invention relates to an EGR control device applied to an internal combustion engine comprising a supercharger.

BACKGROUND ART

In an internal combustion engine comprising a supercharger, which has been conventionally known, respective exhaust valves of cylinders are opened sequentially, and exhaust with high pressure is emitted to an exhaust passage from a cylinder whose exhaust valve is opened. Thereby, exhaust pulsation (periodic fluctuation of an exhaust pressure) arises. However, for example, when an exhaust flow rate is small, a peak value (maximum value) of the exhaust pressure accompanied by the exhaust pulsation decreases. When the peak value of the exhaust pressure is small, a turbine cannot be driven sufficiently, and it becomes impossible for the supercharger to perform sufficient supercharging.

Therefore, one of conventional EGR control devices is configured to close an EGR valve when amplitude of exhaust pulsation (difference between a maximum value and a minimum value of an exhaust pressure within one period of exhaust pulsation) is small. As a result of this, since "volume of a region where pressure of exhaust discharged from a combustion chamber immediately propagates (which will be referred to as "exhaust volume" hereafter)" decreases, a peak value of an exhaust pressure accompanied by exhaust pulsation can be avoided from falling excessively. Therefore, also in such a case, supercharging can be performed (refer to the Patent Document 1 (PTL1), for example).

CITATION LIST

Patent Literature

[PTL1] Japanese Patent Application Laid-Open (kokai) No. H08-246889

SUMMARY OF INVENTION

However, although the above-mentioned conventional EGR control device can suppress the fall of the peak value of the exhaust pressure accompanied by the exhaust pulsation since the EGR valve is closed when the amplitude of the exhaust pulsation is small, but it cannot secure a predetermined of EGR amount. As a result, an operational state in which an emission cannot be improved by EGR occurs frequently.

Furthermore, the EGR valve which the above-mentioned conventional EGR control device uses is disposed at a position near the turbine. For this reason, when the operational state of the internal combustion engine becomes an "operational state in which the amplitude of the exhaust pulsation is large and a target EGR amount is small", the opening of the EGR valve decreases and the exhaust volume decreases substantially. As a result, since the peak value of the exhaust pressure accompanied by the exhaust pulsation increases excessively, a possibility that parts of an exhaust system may be damaged and a possibility that the exhaust valve may be compulsorily opened by the exhaust pressure, etc. arise.

The present invention has been conceived in order to cope with such problems. Namely, one of objectives of the present invention is to provide an EGR control device which can keep magnitude of a peak value of an exhaust pressure accompanied by exhaust pulsation within a suitable range as far as possible while securing a predetermined EGR amount.

An EGR control device according to the present invention is applied to an internal combustion engine 10 which comprises a supercharger (34).

The supercharger (34) has a turbine (34*b*) disposed in an exhaust passage (41, 42) of the internal combustion engine (10) and a compressor (34*a*) disposed in an air intake passage (31, 32) of the internal combustion engine (10).

The EGR control device according to the present invention comprises:

an EGR passage constitution part (51) which connects an upstream part that is a part of said exhaust passage on an upstream side of said turbine with said air intake passage, an upstream EGR valve (52) which is disposed at a first position (51*a*) of said EGR passage constitution part and can change upstream passage cross-sectional area that is cross-sectional area of a channel in the first position (51*a*) of said EGR passage constitution part in response to a change of opening of the upstream EGR valve, a downstream EGR valve (53) which is disposed at a second position (51*b*) of said EGR passage constitution part, which is on a downstream side of said first position (51*a*) in a flow of an EGR gas that is an exhaust gas flowing through said EGR passage constitution part, and can change downstream passage cross-sectional area that is cross-sectional area of a channel in the second position (51*b*) of said EGR passage constitution part in response to a change of opening of the downstream EGR valve, and a control part (60) which controls each of the openings of said upstream EGR valve and said downstream EGR valve.

Said control part (60) is configured to be able to switch an EGR control mode (control mode when controlling an EGR gas flow rate) between a first mode and a second mode.

Said first mode is a mode in which each of the openings of said upstream EGR valve (52) and said downstream EGR valve (53) is controlled such that said upstream passage cross-sectional area is smaller than said downstream passage cross-sectional area and an EGR amount that is a flow rate of said EGR gas is increased or decreased according to the opening of said upstream EGR valve (52).

Said second mode is a mode in which each of the openings of said upstream EGR valve (52) and said downstream EGR valve (53) is controlled such that said downstream passage cross-sectional area is smaller than said upstream passage cross-sectional area and said EGR amount is increased or decreased according to the opening of said downstream EGR valve (53).

Thus, the EGR control device according to the present invention can switch the EGR control mode between the first mode and second mode. When the EGR control mode is the first mode, the upstream passage cross-sectional area is smaller than the downstream passage cross-sectional area, and an EGR gas amount is increased or decreased according to the opening of the upstream EGR valve. Therefore, when the EGR control mode is the first mode, the volume of a part to the first position where the upstream EGR valve is disposed of the EGR passage constitution part is included in the above-mentioned exhaust volume. On the contrary to this, when the EGR control mode is the second mode, the downstream passage cross-sectional area is smaller than the upstream passage cross-sectional area, and the EGR gas amount is increased or decreased according to the opening of the downstream EGR valve. Therefore, when the EGR control mode is the second mode, the volume of a part to the second position, at which the downstream EGR valve is disposed, in the EGR passage constitution part is included in the above-mentioned exhaust volume. Therefore, the exhaust volume when the EGR control mode is the first mode becomes smaller than the exhaust volume when the EGR control mode is the second mode.

Furthermore, said control part (60) is configured to switch said EGR control mode to said second mode when an operational state of said internal combustion engine becomes a first operational state in which a peak value of an exhaust pressure accompanied by exhaust pulsation on an upstream side of said turbine (34*b*) is a first threshold or more, in a case where said EGR control mode is said first mode.

Therefore, since the exhaust volume is increased in a situation where the peak value of the exhaust pressure accompanied by exhaust pulsation is the first threshold or more, the peak value can be avoided from becoming excessive. As a result, damage of parts of an exhaust system and/or opening of the exhaust valve due to the exhaust pressure can be avoided. On the other hand, since the EGR amount is adjusted by the opening of the upstream EGR valve in a situation where the peak value of the exhaust pressure accompanied by exhaust pulsation does not become the first threshold or more, emission can be improved using EGR gas and supercharging can also be performed since the peak value of the exhaust pressure does not decrease excessively.

Furthermore, said control part (60) is configured to switch said EGR control mode to said first mode when an operational state of said internal combustion engine becomes a second operational state in which a peak value of said exhaust pressure is less than a "second threshold that is said first threshold or less", in a case where said EGR control mode is said second mode.

Therefore, since the exhaust volume is decreased in a situation where the peak value of the exhaust pressure accompanied by exhaust pulsation is less than the second threshold, the peak value can be avoided from becoming too small. As a result, since the turbine can be driven sufficiently, supercharging can be performed.

The EGR control device according to one aspect of the present invention comprises an exhaust pressure sensor (83) which detects an exhaust pressure on the upstream side of said turbine.

In this aspect, said control part (60) is configured to;

judge that the operational state of said internal combustion engine has turned into said first operational state (Step 210, Step 230: No) and switch said EGR control mode to said second mode (Step 245) when a "peak value within one period of fluctuation of the exhaust pressure" detected by said exhaust pressure sensor becomes said first threshold (high threshold THhigh) or more in a case where said EGR control mode is said first mode (F=0), and judge that the operational state of said internal combustion engine has turned into said second operational state (Step 255, Step 230: Yes) and switch said EGR control mode to said first mode (Step 235) when the "peak value within one period of the fluctuation of the exhaust pressure" detected by said exhaust pressure sensor becomes less than said second threshold (low threshold THlow) in a case where said EGR control mode is said second mode (F=1).

In accordance with this aspect, the EGR control mode is switched based on the actually detected "peak value of the exhaust pressure accompanied by exhaust pulsation." Therefore, since the peak value can be more certainly avoided from becoming excessive, damage of parts of an exhaust system and/or opening of the exhaust valve due to the exhaust pressure can be avoided more certainly. Furthermore, since the peak value of the exhaust pressure accompanied by exhaust pulsation can be more certainly avoided from becoming too small, supercharging can be performed more certainly.

The EGR control device according to one aspect of the present invention comprises a parameter acquisition part (60, 84, 85, Step 415) which acquires operational state parameters having correlation with a load and rotational speed of said internal combustion engine.

In this aspect, said control part (60) is configured to;

judge that the operational state of said internal combustion engine has turned into said first operational state (Step 425: Yes) and switch said EGR control mode to said second mode (Step 440, Step 430: No, Step 455) when the operational state specified by said acquired operational state parameters becomes an operational state within a first operation range predetermined based on the load and rotational speed (operation range B) in a case where said EGR control mode is said first mode (F=0), and judge that the operational state of said internal combustion engine has turned into said second operational state (Step 450: Yes) and switch said EGR control mode to said first mode (Step 455, Step 430: Yes, Step 435) when the operational state specified by said acquired operational state parameters becomes an operational state within a second operation range predetermined based on the load and rotational speed (operation range A) in a case where said EGR control mode is said second mode (F=1).

In accordance with this aspect, the EGR control mode is switched based on the operational state parameters which have correlation with each of the "load and rotational speed" of the internal combustion engine. Therefore, the peak value can be avoided from increasing excessively or decreasing excessively, without needing high-speed processing and/or an exhaust pressure sensor with high responsiveness for acquiring the peak value of the exhaust pressure accompanied by exhaust pulsation.

In one aspect of the present invention, said control part (60) is configured to;

fully open said downstream EGR valve 53 (Step 235, Step 435) in a case where said EGR control mode is said first mode, and fully open said upstream EGR valve 52 (Step 245, Step 445) in a case where said EGR control mode is said second mode.

In accordance with this aspect, in the first mode, the downstream passage cross-sectional area becomes the largest (maximum) area since the downstream EGR valve is fully opened, and the exhaust volume more certainly becomes small volume since the EGR amount is adjusted with the upstream EGR valve. Accordingly, the peak value of the exhaust pressure accompanied by exhaust pulsation is raised more certainly. Furthermore, in the second mode, the upstream passage cross-sectional area becomes the largest (maximum) area since the upstream EGR valve is fully opened, and the exhaust volume more certainly becomes large volume since the EGR amount is adjusted with the downstream EGR valve. Accordingly, the peak value of the exhaust pressure accompanied by exhaust pulsation is lowered more certainly.

The EGR control device according to one aspect of the present invention further comprises an EGR cooler (54) which is disposed (at a position) between said upstream EGR valve (52) and said downstream EGR valve (53) in said EGR passage constitution part.

The operational state of the internal combustion engine, in which the peak value of the exhaust pressure accompanied by exhaust pulsation increases, is mainly a state of high rotational speed and/or a high load, and exhaust gas temperature in such an operational state is relatively high. The EGR control device according to the present invention sets the EGR control mode to the second mode in such a situation. In the second mode, since the upstream passage cross-sectional area is relatively large, hot exhaustion discharged from the combustion chamber reaches the downstream EGR valve through the EGR passage constitution part, a part thereof flows into an air intake passage, and the remainder returns to the exhaust passage through the EGR passage constitution part again. Accordingly, like the above-mentioned aspect, the temperature of the exhaustion which flows into the turbine in the second mode can be effectively lowered by an EGR cooler by preparing the EGR cooler between the upstream EGR valve and the downstream EGR valve. As a result, since overheat of the turbine can be avoided, a possibility that the turbine may be damaged or thermally deteriorated can be reduced.

In addition, in the above-mentioned explanation, in order to help understanding of the present invention, names and/or reference signs used in embodiments are attached in parenthesis to configurations of inventions corresponding to the embodiments which will be mentioned later. However, respective constituents of the present invention are not limited to the embodiments specified with the above-mentioned names and/or reference signs. Other objectives, other features and accompanying advantages of the present invention will be easily understood from the following explanation about embodiments of the present invention described referring to drawings.

DESCRIPTION OF EMBODIMENTS

Hereafter, embodiments of the present invention will be explained in detail, referring to drawings. However, the present invention is not necessarily limited to the following embodiments.

First Embodiment (Configuration)

Figure 1:
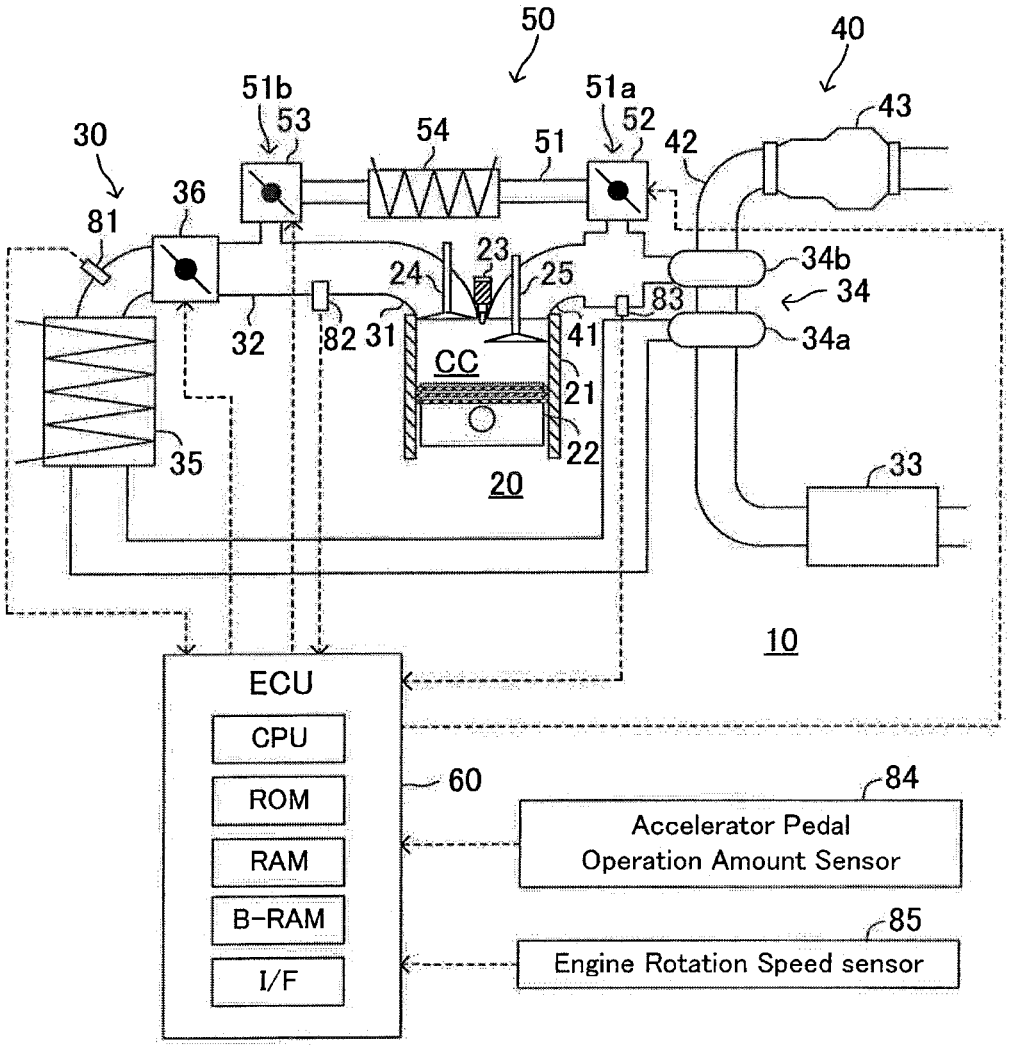
FIG. 1 is a schematic block diagram of an EGR control device according to a first embodiment of the present invention and an internal combustion engine, to which the EGR control device is applied.

An EGR control device according to a first embodiment of the present invention (which may be referred to as a "first device" hereafter) is applied to an internal combustion engine 10 shown in FIG. 1. The internal combustion engines 10 is a multi-cylinder (three-cylinder, in this example), four-stroke cycle, piston-reciprocating diesel engine. In addition, although only a cross section of a specific cylinder of the internal combustion engine 10 is shown in FIG. 1, other cylinders also comprise the same configuration as the cylinder shown in FIG. 1. The internal combustion engine 10 comprises an engine body part 20, an intake system 30, and an exhaust system 40. The first device comprises an EGR apparatus 50, an electronic control unit 60, and various sensors 81 to 85.

The engine body part 20 comprises a main body 21 including a cylinder block, a cylinder head and a crankcase, etc. A cylinder (combustion chamber) CC which houses a piston 22 is formed in the main body 21. A fuel injection valve 23 is formed in an upper part of each cylinder CC. The main body 21 further comprises an intake valve 24 driven by an intake cam which is not illustrated and an exhaust valve 25 driven by an exhaust cam which is not illustrated.

The intake system 30 includes an intake manifold part (including an intake port) 31, an intake pipe 32, an air cleaner 33, a compressor 34*a* of a supercharger 34, an intercooler 35 and a throttle valve 36. The intake manifold part 31 is connected to the combustion chamber CC. A communication part between the intake manifold part 31 and the combustion chamber CC is opened and closed by the intake valve 24. The intake pipe 32 is connected to the intake manifold part 31. The intake manifold part 31 and the intake pipe 32 constitute an air intake passage. The air cleaner 33, the compressor 34*a*, the intercooler 35 and the throttle valve 36 are disposed in the air intake passage in order towards a downstream from an upstream of air intake.

The exhaust system 40 includes an exhaust manifold part (including an exhaust port part) 41, an exhaust pipe 42, a turbine 34*b* of and the supercharger 34, and an exhaust purification apparatus 43. The exhaust manifold part 41 is connected to the combustion chamber CC. A communication part between the exhaust manifold part (exhaust port part) 41 and the combustion chamber CC is opened and closed by the exhaust valve 25. The exhaust pipe 42 is connected to the exhaust manifold part 41. The exhaust manifold part 41 and the exhaust pipe 42 constitute an exhaust passage. The turbine 34*b* and the exhaust purification apparatus 43 are disposed in the exhaust passage in order towards a downstream from an upstream of exhaustion.

The EGR apparatus 50 includes an exhaust recirculating pipe 51, an upstream EGR valve 52, a downstream EGR valve 53 and an EGR cooler 54.

The exhaust recirculating pipe 51 is an EGR passage constitution part constituting a path (namely, an EGR passage) through which EGR gas passes. The exhaust recirculating pipe 51 brings a "region on an upstream side of the turbine 34*b* (combustion chamber CC side)" of the exhaust manifold part 41 constituting the exhaust passage and a "region on a downstream side of the throttle valve 36 (combustion chamber CC side)" of the intake manifold part 31 constituting the air intake passage in communication with each other.

The upstream EGR valve 52 is disposed at a "position 51*a* in the vicinity of the communication part between the exhaust recirculating pipe 51 and the exhaust manifold part 41" of the exhaust recirculating pipe 51. Hereafter, the position where the upstream EGR valve 52 is disposed will be referred to as a "first position 51*a*." In a flow of the EGR gas which flows through the exhaust recirculating pipe 51, the first position 51*a* is a position on the most upstream side in the exhaust recirculating pipe 51. The upstream EGR valve 52 changes its opening in response to an instruction (drive) signal sent from the electronic control unit 60. Therefore, the upstream EGR valve 52 can change upstream passage cross-sectional area that is cross-sectional area of a channel at the first position 51*a* of the exhaust recirculating pipe 51. When the upstream EGR valve 52 is fully closed, the upstream passage cross-sectional area becomes "0", and EGR is stopped.

The downstream EGR valve 53 is disposed at a "position 51*b* in the vicinity of the communication part of the exhaust recirculating pipe 51 and the intake manifold part 31" of the exhaust recirculating pipe 51. Hereafter, the position where the downstream EGR valve 53 is disposed will be referred to as a "second position 51*b*." In a flow of the EGR gas which flows through the exhaust recirculating pipe 51, the second position 51*b* is a place on the most downstream side in the exhaust recirculating pipe 51. The downstream EGR valve 53 changes its opening in response to an instruction (drive) signal sent from the electronic control unit 60. Therefore, the downstream EGR valve 53 can change downstream passage cross-sectional area that is cross-sectional area of a channel at the second position 51*b* of the exhaust recirculating pipe 51. When the downstream EGR valve 53 is fully closed, the downstream passage cross-sectional area becomes "0", and EGR is stopped.

The EGR cooler 54 is a water cooling cooler which cools the EGR gas. The EGR cooler 54 is disposed "between the upstream EGR valve 52 and the downstream EGR valve 53" in the exhaust recirculating pipe 51.

By the way, when the EGR amount is adjusted by fully opening the upstream EGR valve 52 and setting the downstream EGR valve 53 to a predetermined opening of less than full open, "volume of a region where pressure of the exhaustion discharged from the combustion chamber CC immediately propagates (namely, the exhaust volume)" becomes the sum (V0+VL) of "volume V0 of the exhaust passage from the communication part between the combustion chamber CC and the exhaust manifold part 41 to an exhaust entry part of the turbine 34*b*" and "volume VL of the EGR passage from the communication part between the exhaust manifold part 41 and the exhaust recirculating pipe 51 to the downstream EGR valve 53." In addition, the sum (V0+VL) of the volume V0 and the volume VL may be referred to as "large volume" or "first volume" for convenience' sake.

On the contrary to this, when the EGR amount is adjusted by fully opening the downstream EGR valve 53 and setting the upstream EGR valve 52 to a predetermined opening of less than full open, the exhaust volume becomes the sum (V0+VS) of the "volume V0 of the exhaust passage" and the "volume VS of the EGR passage from the communication part of the exhaust manifold part 41 and the exhaust recirculating pipe 51 to the upstream EGR valve 52." In addition, the "volume VS of the EGR passage to the upstream EGR valve 52" is very small. Therefore, when the EGR amount is adjusted by fully opening the downstream EGR valve 53 and setting the upstream EGR valve 52 to a predetermined opening of less than full open, the exhaust volume becomes substantially equal to the "volume V0 of the exhaust passage." In addition, the sum (V0+VS) of the volume V0 and the volume VS may be referred to as "small volume" or "second volume" for convenience' sake.

The electronic control unit (which will be referred to as an "ECU" hereafter) 60 is an electronic control circuitry including a microcomputer. The microcomputer includes a CPU (Central Processing Unit), an ROM (Read-Only Memory), an RAM (Random-Access Memory), backup RAM and an interface, etc. The CPU realizes various functions by performing instructions (programs, routines) stored in the ROM. The ECU is connected with various sensors 81 to 85 which will be mentioned below, and receives (is input) signals from these sensors. The ECU sends out an instruction (drive) signal to each actuator (the fuel Injection valve 23, the upstream EGR valve 52 and the downstream EGR valve 53, etc.) in accordance the instruction from the CPU.

An air flow meter 81 is disposed in a region between the intercooler 35 and the throttle valve 36 in the intake pipe 32. The air flow meter 81 measures a mass flow rate Ga of the atmosphere (fresh air) which flows into the combustion chamber CC, and outputs a signal indicating the flow rate (fresh air flow rate) Ga.

An intake pipe pressure sensor 82 is disposed in a region between the throttle valve 36 in the intake pipe 32 and the combustion chamber CC. The intake pipe pressure sensor 82 measures pressure (air intake pressure) Pin in the region where the intake pipe pressure sensor 82 is disposed, and outputs a signal indicating the air intake pressure Pin.

An exhaust pipe pressure sensor 83 is disposed in a region between the combustion chamber CC and the turbine 34*b* in the exhaust manifold part 41. The exhaust pipe pressure sensor 83 measures pressure (exhaust pressure) Pex in the region where the exhaust pipe pressure sensor 83 is disposed, and outputs a signal indicating the exhaust pressure Pex.

An accelerator pedal operation amount sensor 84 detects an operation amount of an accelerator pedal, which is not illustrated, of a vehicle with the internal combustion engine 10 mounted thereon, and outputs a signal indicating an accelerator pedal operation amount AP. The accelerator pedal operation amount AP is a parameter which indicates a load of the internal combustion engine 10.

An engine rotational speed sensor 85 detects rotational speed NE of the internal combustion engine 10, and outputs a signal indicating the engine rotational speed NE.

In addition, an ECU 60 is configured to determine a fuel injection amount in accordance with a well-known method based on the accelerator pedal operation amount AP and the engine rotational speed NE, etc., and to control the fuel injection valve 23 such that the determined fuel injection amount of fuel is injected from the fuel injection valve 23.

(Outline of Operation)

Next, an outline of operation of the first device will be explained.

The first device switches an EGR control mode between a first mode and a second mode which will be mentioned below. The EGR control mode is a control mode of the "upstream EGR valve 52 and downstream EGR valve 53" when supplying EGR gas to the combustion chamber CC.

First Mode: The downstream EGR valve 53 is fully opened, and the opening of the upstream EGR valve 52 is adjusted (controlled) such that an actual amount of EGR gas (actual EGR amount) becomes a predetermined EGR amount.

Second Mode: The upstream EGR valve 52 is fully opened, and the opening of the downstream EGR valve 53 is adjusted (controlled) such that the actual EGR amount becomes a predetermined EGR amount.

The first device detects (obtains) a "peak value in a single period of pulsation (peak value of exhaust pressure accompanied by exhaust pulsation)" of the exhaust pressure Pex which pulsates due to discharge of exhaust gas from each cylinder. Hereafter, this detected peak value may be referred to as an "actual exhaust pulsation peak value."

In a case where the EGR control mode is set to the first mode, the first device switches the EGR control mode to the second mode when the actual exhaust pulsation peak value becomes a high threshold (first threshold) THhigh or more in association with a rise in engine rotational speed and/or a load of an engine. As a result of this, since the exhaust volume increases from the small volume to the large volume, the first device can reduce the peak value of the exhaust pressure accompanied by exhaust pulsation. The high threshold THhigh is set such that there is a high possibility that a situation where parts of the exhaust system are damaged and/or a situation where the exhaust valve 25 is depressed by the exhaust pressure to be opened (compulsory opening of the exhaust valve) may arise when the actual exhaust pulsation peak value becomes the high threshold THhigh or more.

In a case where the EGR control mode is set to the second mode, the first device switches the EGR control mode to the first mode when the actual exhaust pulsation peak value becomes less than a low threshold (second threshold) THlow in association with a drop in engine rotational speed and/or a load of an engine. As a result of this, since the exhaust volume decreases from the large volume to the small volume, the first device can raise the peak value of the exhaust pressure accompanied by exhaust pulsation. Therefore, also in this case, supercharging by the supercharger 34 can be performed substantially. The low threshold THlow has been set to a value of the high threshold THhigh or less. The low threshold THlow is set such that the turbine 34*b* of the supercharger 34 becomes unable to be sufficiently driven when the peak value of the exhaust pressure accompanied by exhaust pulsation becomes less than the low threshold THlow, for example. In addition, it is preferable that the low threshold THlow is set such that the peak value of exhaust pulsation does not become the high threshold THhigh or more immediately after the EGR control mode is switched from the second mode to the first mode when the actual exhaust pulsation peak value becomes less than the low threshold THlow. Namely, it is desirable that the low threshold THlow is set to a value which is a predetermined positive value smaller than the high threshold THhigh.

(Specific Operation)

Figure 2:
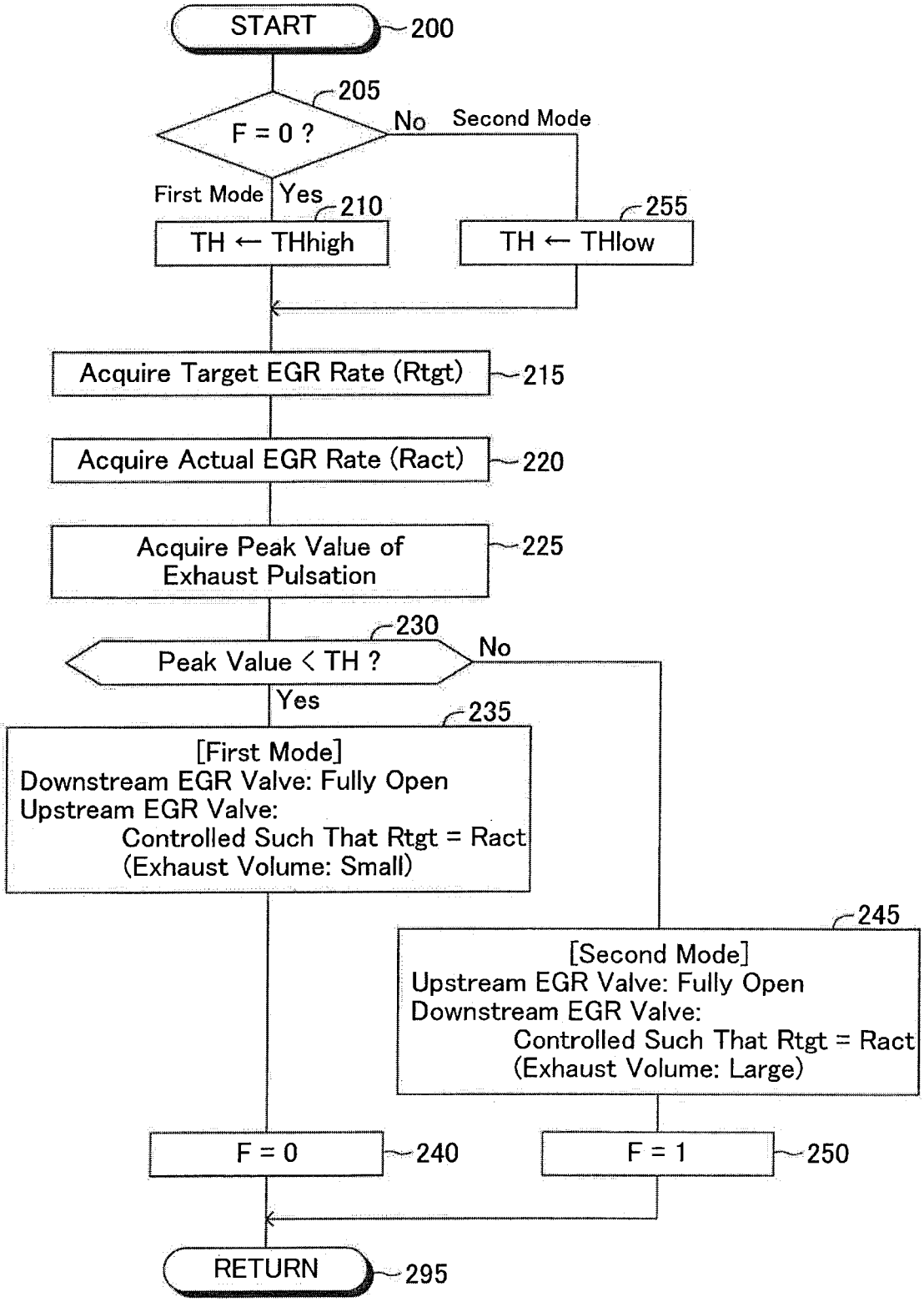
FIG. 2 is a flowchart for showing a routine performed by a CPU of the EGR control device according to the first embodiment of the present invention.

The CPU of the ECU 60 is configured to perform a routine shown by the flowchart in FIG. 2 whenever a predetermined time has passed. Therefore, the CPU starts processing from Step 200 at a predetermined timing to progress to Step 205, and judges whether a value of a mode flag F is 0. The mode flag F indicates that the EGR control mode is the above-mentioned first mode when its value is "0." The mode flag F indicates that the EGR control mode is the above-mentioned second mode when its value is "1." The mode flag F is set to "0" by an initialization routine performed by the CPU, when an ignition key switch, which is not shown, is changed from an OFF position to an ON position (this time point will be referred to as an "IG ON time" hereafter). Furthermore, the CPU is configured to set the EGR control mode to the first mode at the IG ON time.

When the value of the mode flag F is 0 at the present moment, the CPU judges as "Yes" at Step 205 to progress to Step 210, and sets the threshold TH to the high threshold THhigh.

Next, the CPU performs processing of Step 215 to Step 225, which will be mentioned below, in order, and progresses to Step 230.

Step 215: The CPU finds a target EGR rate Rtgt by applying the accelerator pedal operation amount AP and the engine rotational speed NE to a look-up table stored in the RAM. The target EGR rate Rtgt may be determined based on other engine operational state parameters including the fresh air flow rate Ga and a fuel injection amount, etc.

Step 220: The CPU computes an actual EGR rate Ract in accordance with the following formula (1) to formula (3). Gegr is an EGR gas flow rate. Gcyl is a flow rate of all gas which flows into the combustion chamber CC. a and b are predetermined constants. Ga is the fresh air flow rate Ga detected by the air flow meter 81. Pin is the air intake pressure Pin detected by the intake pipe pressure sensor 82.

$$Ract=Gegr/(Ga+Gegr) \quad (1)$$

$$Gegr=Gcyl-Ga \quad (2)$$

$$Gcyl=a\cdot Pin+b \quad (3)$$

Step 225: The CPU acquires an exhaust pulsation peak value based on the exhaust pressure Pex detected by the exhaust pipe pressure sensor 83 (namely, the actual exhaust pulsation peak value). The actual exhaust pulsation peak value is the maximum value of the exhaust pressure Pex in crank angles obtained by dividing crank angles required for one cycle of the internal combustion engine 10 by the number of cylinders (namely, one period of exhaust pulsation).

Next, the CPU progresses to Step 230, and judges whether the actual exhaust pulsation peak value acquired at Step 225 is less than the threshold TH. At this time point, the threshold TH has been set to the high threshold THhigh at Step 210.

Now, it is assumed that when an exhaust flow rate is small since the load of the engine is comparatively low and the engine rotational speed is also comparatively low and, for that reason, the actual exhaust pulsation peak value is less than the high threshold THhigh. In this case, the CPU judges as "Yes" at Step 230 to progress to Step 235, and sets the control mode of EGR to the first mode.

More specifically, the CPU sets the opening of the downstream EGR valve 53 to full open (the maximum opening) at Step 235. For this reason, the actual EGR amount is not controlled by the downstream EGR valve 53. Furthermore, at Step 235, the CPU adjusts (controls) the opening of the upstream EGR valve 52 to be a "relatively small opening of less than full open" such that the actual EGR rate Ract agrees with the target EGR rate Rtgt (namely, such that the actual EGR amount agrees with the target EGR amount). In other words, the CPU controls respective openings of the upstream EGR valve 52 and the downstream EGR valve 53 such that the upstream passage cross-sectional area is smaller than the downstream passage cross-sectional area and an EGR gas amount is increased or decreased by the opening of the upstream EGR valve 52. Ln this case, since the exhaust volume becomes the small volume (substantially, the volume V0), the peak value of the exhaust pressure accompanied by exhaust pulsation becomes comparatively large even when the exhaust flow rate is small. As a result, since the turbine 34*b* is driven efficiently, supercharging by the supercharger 34 can be performed.

Next, the CPU progresses to Step 240 to set the value of the mode flag F to 0. Thereafter, the CPU progresses to Step 295 to once end this routine. Hereafter, as long as the actual exhaust pulsation peak value is less than the high threshold THhigh, the CPU controls the EGR amount in accordance with the first mode by repeatedly performing the above-mentioned processing.

When the exhaust flow rate increases due to increase in the load of the internal combustion engine 10 and/or a rise in the engine rotational speed NE, the actual exhaust pulsation peak value becomes the high threshold THhigh or more. In this case, when the CPU progresses to Step 230, the CPU judges as "No" at that Step 230, and progresses to Step 245 to set the control mode of EGR to the second mode.

More specifically, the CPU sets the opening of the upstream EGR valve 52 to full open (the maximum opening) at Step 245. For this reason, the actual EGR amount is not controlled by the upstream EGR valve 52. Furthermore, at Step 245, the CPU adjusts (controls) the opening of the downstream EGR valve 53 to be a "relatively small opening of less than full open" such that the actual EGR rate Ract agrees with the target EGR rate Rtgt (namely, such that the actual EGR amount agrees with the target EGR amount). In other words, the CPU controls respective openings of the upstream EGR valve 52 and the downstream EGR valve 53 such that the downstream passage cross-sectional area is smaller than the upstream passage cross-sectional area and the EGR gas amount is increased or decreased by the opening of the downstream EGR valve 53. In this case, since the exhaust volume becomes the large volume (V0+VL), the peak value of the exhaust pressure accompanied by exhaust pulsation becomes comparatively small even when the exhaust flow rate is large. As a result, damage of parts of the exhaust system and/or opening of the exhaust valve due to the exhaust pressure can be avoided.

Thereafter, the CPU progresses to Step 250 to set the value of the mode flag F to "1", and progresses to Step 295 to once end this routine.

In this state, since the value of the mode flag F is "1" when the CPU starts processing from Step 200 again and progresses to Step 205, the CPU judges as "No" at that Step 205. Then, the CPU progresses to Step 255, and sets the threshold TH to "the low threshold THlow smaller than the high threshold THhigh." The low threshold THlow may be equal to the high threshold THhigh.

Thereafter, the CPU performs processing in the above-mentioned Step 215 to Step 225 to progress to Step 230, and judges whether the actual exhaust pulsation peak value acquired at Step 225 is less than the threshold TH. At this time point, the threshold TH has been set to the low threshold THlow. Therefore, the CPU judges whether the actual exhaust pulsation peak value is less than the low threshold THlow or not, at Step 230.

When the actual exhaust pulsation peak value is the low threshold THlow or more, the CPU judges as "No" at Step 230, and performs processing at Step 245 and Step 250. In this case, the EGR control mode is maintained in the second mode. Thereafter, the CPU progresses to Step 295 to once end this routine.

Thereafter, when the exhaust flow rate decreases in association with a drop in a load of the engine and/or the engine rotational speed, the actual exhaust pulsation peak value becomes less than the low threshold THlow. In this case, when the CPU progresses to Step 230, the CPU judges as "Yes" at that Step 230, and performs processing in Step 235 and Step 240. Thereby, the control mode of EGR is returned to the first mode. As a result of this, since the peak value of the exhaust pressure accompanied by exhaust pulsation becomes comparatively large, supercharging by the supercharger 34 can be performed. The above is specific operation of the first device.

Figure 3:
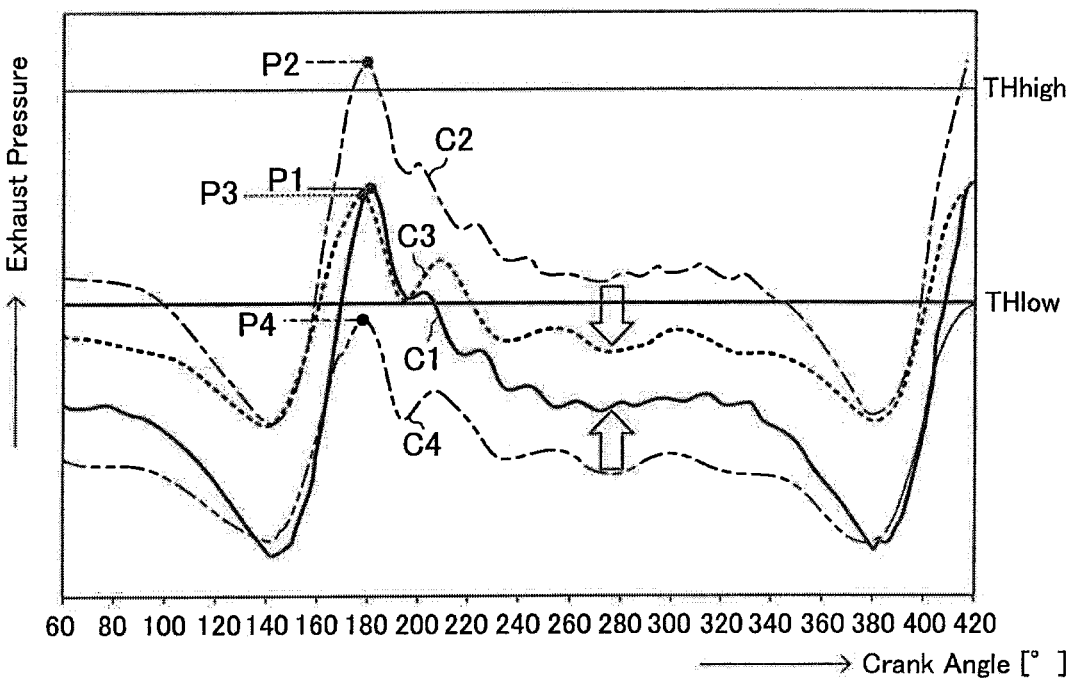
FIG. 3 is a graph for showing a waveform of an exhaust pressure of the internal combustion engine, to which the EGR control device according to the first embodiment of the present invention is applied.

FIG. 3 is a graph for showing the exhaust pressure Pex acquired from the exhaust pipe pressure sensor 83. Immediately after starting the operation of the internal combustion engine 10, the value of the mode flag F has been set to "0." Therefore, the EGR control mode is set to the first mode. In this case, the exhaust pressure Pex changes with exhaust pulsation, as shown by a solid line C1, and the actual exhaust pulsation peak value P1 becomes a value between the low threshold THlow and the high threshold THhigh.

When the exhaust flow rate increases due to increase in the load of the internal combustion engine 10 and/or a rise in the engine rotational speed NE in a case where the EGR control mode has been set to the first mode, the exhaust pressure Pex increases and changes as shown by a dash-dot line C2. At this time, the actual exhaust pulsation peak value P2 becomes larger than the high threshold THhigh. Then, the CPU switches the EGR control mode to the second mode, when the actual exhaust pulsation peak value becomes the high threshold THhigh or more. As a result of this, the exhaust pressure Pex is made to fall as shown in a broken line C3, and the actual exhaust pulsation peak value P3 becomes a value between the low threshold THlow and the high threshold THhigh. Accordingly, damage of parts of the exhaust system and/or opening of the exhaust valve due to the exhaust pressure can be avoided.

On the other hand, when the exhaust flow rate decreases in association with a drop in a load and/or the engine rotational speed NE of the internal combustion engine 10 in a case where the EGR control mode has been set to the second mode, the exhaust pressure Pex decreases and changes as shown by a two-dot chain line C4. At this time, the actual exhaust pulsation peak value P4 becomes smaller than the low threshold THlow. Then, the CPU switches the EGR control mode to the first mode, when the actual exhaust pulsation peak value becomes less than the low threshold THlow. As a result of this, the exhaust pressure Pex is made to increase as shown in a solid line C1, and the actual exhaust pulsation peak value P1 becomes a value between the low threshold THlow and the high threshold THhigh. Accordingly, since the peak value of the exhaust pressure accompanied by exhaust pulsation becomes comparatively large, supercharging by the supercharger 34 can be performed sufficiently.

Second Embodiment

Next, an EGR control device according to a second embodiment of the present invention (which may be referred to as a "second device" hereafter) will be explained. The second device is different from the first device only in a point that the second device acquires operational state parameters having correlation with each of a load and rotational speed of the internal combustion engine 10, without acquiring the actual exhaust pulsation peak value, and switches the EGR control mode between the first mode and the second mode based on an operational state of the internal combustion engine 10 specified by the operational state parameters. Hereafter, this difference will be explained mainly.

(Specific Operation)

Figure 4:
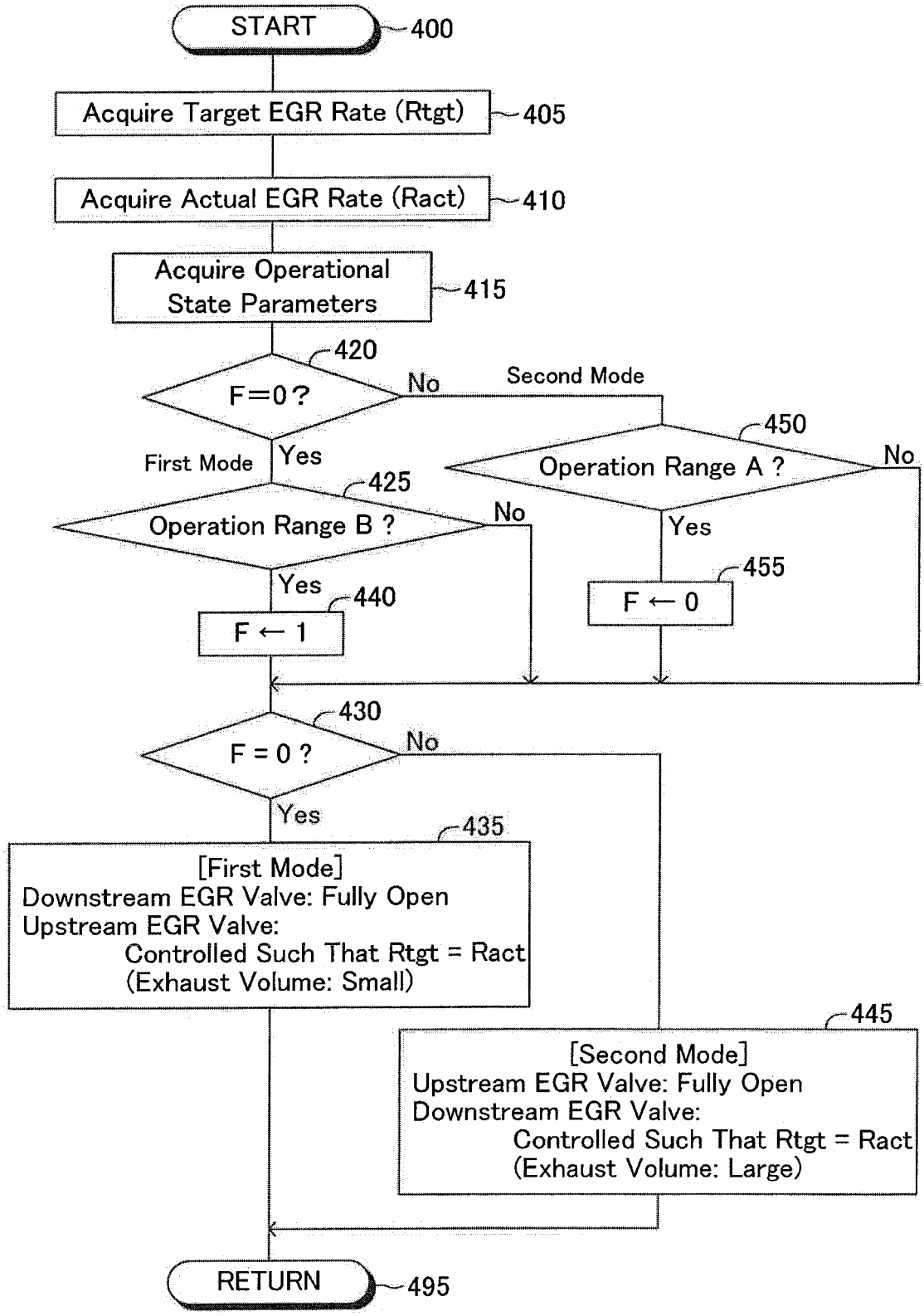
FIG. 4 is a flowchart for showing a routine performed by a CPU of an EGR control device according to a second embodiment of the present invention.

The CPU of ECU 60 of the second device is configured to perform a "routine shown by a flowchart in FIG. 4 in place of FIG. 2" whenever a predetermined time has passed. Therefore, the CPU starts processing from Step 400 at a predetermined timing to perform processing at Step 405 to Step 415, which will be mentioned below, in order, and progresses to Step 420.

Step 405: The CPU performs processing similar to that at Step 215 to acquire the target EGR rate Rtgt.

Step 410: The CPU performs processing similar to that at Step 220 to acquire the actual EGR rate Ract.

Step 415: The CPU acquires a load (although it is the accelerator pedal operation amount AP here, it may be the fuel injection amount) and the engine rotational speed NE of the internal combustion engine 10 as operational state parameters of the internal combustion engine 10.

The CPU judges whether the value of the mode flag F is 0 at Step 420. The value of this mode flag F is set to "0" by the above-mentioned initialization routine. When the value of the mode flag F is "0", the CPU judges as "Yes" at Step 420 to progress to Step 425, and judges whether a "current operational state of the internal combustion engine 10 specified by the operational state parameters acquired at Step 415" is in a state within an operation range B (first operation range) shown in FIG. 5 or not.

Figure 5:
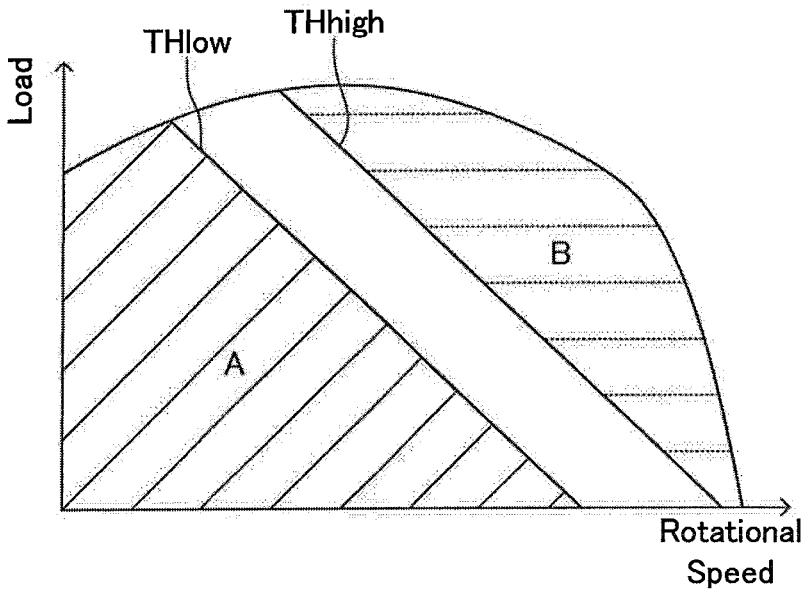
FIG. 5 is a map about operation ranges of an internal combustion engine, to which the CPU of the EGR control device according to the second embodiment of the present invention refers.

FIG. 5 is a graph with a horizontal axis representing the engine rotational speed NE and a vertical axis representing the load (accelerator pedal operation amount AP), for showing "operation ranges of the internal combustion engine 10." The second device has memorized information shown in this graph in the ROM in a map format. The operation range B shown in FIG. 5 is an operation range where the peak value of the exhaust pressure accompanied by exhaust pulsation exceeds the high threshold THhigh when the EGR control mode is the first mode. The operation range A (second operation range) shown in FIG. 5 is an operation range where the peak value of the exhaust pressure accompanied by exhaust pulsation becomes less than the low threshold THlow when the EGR control mode is the second mode.

When the present moment is immediately after starting the operation of the internal combustion engine 10, the current operational state of the internal combustion engine 10 is not in a state within the operation range B. In this case, the CPU judges as "No" at Step 425, and progresses directly to Step 430.

At Step 430, the CPU judges whether the value of the mode flag F is 0. At the present moment, the value of the mode flag F is "0." Accordingly, the CPU judges as "Yes" at Step 430, progresses to Step 435, and sets the control mode of EGR to the first mode like Step 235. As a result of this, since the exhaust volume becomes the small volume (substantially, the volume V0), the peak value of the exhaust pressure accompanied by exhaust pulsation becomes comparatively large even when the exhaust flow rate is small. As a result, since the turbine 34*b* is driven efficiently, supercharging by the supercharger 34 can be performed. Thereafter, the CPU progresses to Step 495, and once ends this routine.

Thereafter, when a load and/or the engine rotational speed NE of the internal combustion engine 10 increases, the operational state of the internal combustion engine 10 goes into a state within the operation range B. Namely, the operational state of the internal combustion engine 10 goes into a state where the peak value of the exhaust pressure accompanied by exhaust pulsation exceeds the high threshold THhigh (the first operational state). In this case, when the CPU progresses to Step 425, the CPU judges as "Yes" at that Step 425 to progress to Step 440, and sets the value of the mode flag F to "1."

Thereby, the CPU judges as "No" at the following Step 430 to progress to Step 445, and sets the control mode of EGR to the second mode like Step 245. As a result of this, since the exhaust volume becomes the large volume (V0+VL), the peak value of the exhaust pressure accompanied by exhaust pulsation is made to fall to be a value between the low threshold THlow and the high threshold THhigh. Accordingly, damage of parts of the exhaust system and/or opening of the exhaust valve due to the exhaust pressure can be avoided. Thereafter, the CPU progresses to Step 495, and once ends this routine.

In this state, since the value of the mode flag F is "1" when the CPU starts processing from Step 400 again and progresses to Step 420 via Step 405 to Step 415, the CPU judges as "No" at that Step 420. And, the CPU progresses to Step 450, and judges whether the current operational state of the internal combustion engine 10 specified by the operational state parameters is within a state within the operation range A shown in FIG. 5.

When the current operational state of the internal combustion engine 10 is not a state within the operation range A, the CPU judges as "No" at Step 450, and progresses directly to Step 430. Since the value of the mode flag F is "1" at this time, the CPU judges as "No" at Step 430 to progress to Step 445, and maintains the EGR control mode in the second mode.

Thereafter, when a load and/or the engine rotational speed NE of the internal combustion engine 10 decreases, the operational state of the internal combustion engine 10 goes into a state within the operation range A. Namely, the operational state of the internal combustion engine 10 goes into a state where the peak value of the exhaust pressure accompanied by exhaust pulsation becomes less than the low threshold THlow (second operational state). In this case, when the CPU progresses to Step 450, the CPU judges as "Yes" at that Step 450 to progress to Step 455, and sets the value of the mode flag F to "0."

Thereby, the CPU judges as "Yes" at the following Step 430 to progress to Step 435, and sets the EGR control mode to the first mode. As a result of this, since the peak value of the exhaust pressure accompanied by exhaust pulsation becomes comparatively large, supercharging by the supercharger 34 can be performed. Thereafter, the CPU progresses to Step 495, and once ends this routine.

As explained above, in each embodiment of the present invention, the peak value of the exhaust pressure accompanied by exhaust pulsation can be prevented from becoming either of a too large value and a too small value by switching the EGR control mode between the first mode and the second mode. As a result of this, damage of parts of the exhaust system and/or opening of the exhaust valve due to the exhaust pressure can be avoided, while attaining supercharging of the supercharger 34 and introduction of EGR gas in a large operation range.

Furthermore, in each embodiment of the present invention, the EGR cooler 54 is disposed between the upstream EGR valve 52 and the downstream EGR valve 53. The operational state of the internal combustion engine, in which peak value of the exhaust pressure accompanied by an exhaust pulsation increases, is mainly a state of high rotational speed and a high load, and the exhaust gas temperature in such an operational state is relatively high. In such a case, in each embodiment of the present invention, the EGR control mode is set to the second mode. In the second mode, hot exhaustion discharged from the combustion chamber CC reaches the exhaust recirculating pipe 51 and the EGR cooler 54, a part thereof flows into the air intake passage, and the remainder returns to the exhaust passage. Accordingly, in each embodiment of the present invention, the temperature of the exhaustion which flows into the turbine 34*b* can be effectively lowered. As a result, since overheat of the turbine 34*b* and its component can be avoided, a possibility that they may be damaged or thermally deteriorated can be reduced.

The present invention is not limited to the above-mentioned embodiments, and various modifications can be adopted within the scope of the present invention. For example, the internal combustion engine 10 may be a gasoline engine. Furthermore, the EGR cooler 54 is not essential. In addition, the downstream side part of the exhaust recirculating pipe 51 may be connected to a position between the throttle valve 36 and the intercooler 35 in the air intake passage, or a position between the intercooler 35 and the compressor 34*a* in the air intake passage.

Furthermore, although the upstream EGR valve 52 and the downstream EGR valve 53 are controlled such that the actual EGR rate agrees with the target EGR rate in each above-mentioned embodiment, the upstream EGR valve 52 and the downstream EGR valve 53 may be controlled such that the actual EGR amount agrees with the target EGR amount.

In addition, when the EGR control mode is set to the first mode, the opening of the downstream EGR valve 53 does not need to be full open, and the downstream EGR valve 53 just needs to be controlled such that the downstream passage cross-sectional area becomes larger than the upstream passage cross-sectional area. In other words, when the EGR control mode is set to the first mode, the opening of the downstream EGR valve 53 just needs to be set such that conduction of EGR gas is not impeded substantially.

Similarly, when the EGR control mode is set to the second mode, the opening of the upstream EGR valve 52 does not need to be full open, and the upstream EGR valve 52 just needs to be controlled such that the upstream passage cross-sectional area becomes larger than the downstream passage cross-sectional area. In other words, when the EGR control mode is set to the second mode, the opening of the upstream EGR valve 52 just needs to be set such that conduction of EGR gas is not impeded substantially. Furthermore, at Step 225 and Step 230 in the first embodiment, instead of acquiring the peak value of the actual exhaust pulsation and using the peak value, the peak value of exhaust pulsation may be presumed by computing based on the EGR control mode, the fuel injection amount and the engine rotational speed, etc. and the estimated (presumed) value may be used, for example.

REFERENCE SIGNS LIST

10: Internal Combustion Engine, 31: Intake Manifold Part, 32: Intake Pipe, 34: Supercharger, 34*a*: Compressor, 34*b*: Turbine, 35: Intercooler, 40: Exhaust System, 41: Exhaust Manifold Part, 42: Exhaust Pipe, 50: EGR Apparatus, 51: Exhaust Recirculating Pipe, 51*a*: First Position, 51*b*: Second Position, 52: Upstream EGR Valve, 53: Downstream EGR Valve, 54: EGR Cooler, 60: Electronic Control Unit, 81: Air Flow Meter, 82: Intake Pipe Pressure Sensor, 83: Exhaust Pipe Pressure Sensor, 84: Accelerator Pedal Operation Amount Sensor, 85: Engine Rotational Speed Sensor.

The invention claimed is:

1. An EGR control device applied to an internal combustion engine which comprises a supercharger having a turbine disposed in an exhaust passage of the internal combustion engine and a compressor disposed in an air intake passage of the internal combustion engine, the EGR control device comprising:

an EGR passage constitution part which connects an upstream part that is a part of said exhaust passage on an upstream side of said turbine with said air intake passage, an upstream EGR valve which is disposed at a first position of said EGR passage constitution part and configured to change upstream passage cross-sectional area that is cross-sectional area of a channel in the first position of said EGR passage constitution part in response to a change of opening of the upstream EGR valve, a downstream EGR valve which is disposed at a second position of said EGR passage constitution part, which is on a downstream side of said first position in a flow of an EGR gas that is an exhaust gas flowing through said EGR passage constitution part, and configured to change downstream passage cross-sectional area that is cross-sectional area of a channel in the second position of said EGR passage constitution part in response to a change of opening of the downstream EGR valve, and a control part comprising a central processing unit programmed to perform instructions stored in a non-transitory computer-readable medium to control each of the openings of said upstream EGR valve and said downstream EGR valve, and said control part being configured to:

switch an EGR control mode between a first mode and a second mode, wherein the control part controls each of the openings of said upstream EGR valve and said downstream EGR valve such that said upstream passage cross-sectional area is smaller than said downstream passage cross-sectional area and an EGR amount that is a flow rate of said EGR gas is increased or decreased according to the opening of said upstream EGR valve in said first mode, and the control part controls each of the openings of said upstream EGR valve and said downstream EGR valve such that said downstream passage cross-sectional area is smaller than said upstream passage cross-sectional area and said EGR amount is increased or decreased according to the opening of said downstream EGR valve in said second mode, switch said EGR control mode to said second mode when an operational state of said internal combustion engine becomes a first operational state in which a peak value of an exhaust pressure accompanied by exhaust pulsation on an upstream side of said turbine is a first threshold or more, in a case where said EGR control mode is said first mode, and switch said EGR control mode to said first mode when an operational state of said internal combustion engine becomes a second operational state in which a peak value of said exhaust pressure is less than a second threshold that is said first threshold or less, in a case where said EGR control mode is said second mode.

2. The EGR control device according to claim 1, comprising:

an exhaust pressure sensor which detects an exhaust pressure on the upstream side of said turbine, wherein:

said control part is configured to:

judge that the operational state of said internal combustion engine has turned into said first operational state and switch said EGR control mode to said second mode when a peak value within one period of fluctuation of the exhaust pressure detected by said exhaust pressure sensor becomes said first threshold or more in a case where said EGR control mode is said first mode, and judge that the operational state of said internal combustion engine has turned into said second operational state and switch said EGR control mode to said first mode when the peak value within one period of the fluctuation of the exhaust pressure detected by said exhaust pressure sensor becomes less than said second threshold in a case where said EGR control mode is said second mode.

3. The EGR control device according to claim 1, comprising:

a parameter acquisition part configured to acquire an operational state parameter having correlation to each of a load and rotational speed of said internal combustion engine, said control part being configured to:

judge that the operational state of said internal combustion engine has turned into said first operational state and switch said EGR control mode to said second mode when the operational state specified by said acquired operational state parameter becomes an operational state within a first operation range predetermined based on the load and the rotational speed in a case where said EGR control mode is said first mode, and judge that the operational state of said internal combustion engine has turned into said second operational state and switch said EGR control mode to said first mode when the operational state specified by said acquired operational state parameter becomes an operational state within a second operation range predetermined based on the load and the rotational speed in a case where said EGR control mode is said second mode.

4. The EGR control device according to claim 1, wherein:

said control part is configured to:

fully open said downstream EGR valve in a case where said EGR control mode is said first mode, and fully open said upstream EGR valve in a case where said EGR control mode is said second mode.

5. The EGR control device according to claim 1, further comprising:

an EGR cooler which is disposed between said upstream EGR valve and said downstream EGR valve in said EGR passage constitution part.

* * * * *